US005387780A

United States Patent [19]

Riley

[11] Patent Number: 5,387,780

[45] Date of Patent: Feb. 7, 1995

[54] MICROWAVE HOT WATER HEATING SYSTEM

[75] Inventor: William P. Riley, 115 Moore St., East Boston, Mass. 02128

[73] Assignees: Edwin J. Riley, Milton; William P. Riley, East Boston, both of Mass.

[21] Appl. No.: 125,515

[22] Filed: Sep. 23, 1993

[51] Int. Cl.[6] ..... H05B 6/80

[52] U.S. Cl. ..... 219/688; 219/748; 219/757

[58] Field of Search ..... 219/10.55 R, 10.55 A, 219/10.55 M, 10.55 F, 688, 746, 748, 756, 757, 759, 761

[56] References Cited

U.S. PATENT DOCUMENTS

| | | | |
|---|---|---|---|
| 3,816,689 | 6/1974 | Long | 219/10.55 R |
| 3,920,945 | 11/1975 | Smith | 219/10.55 R |
| 4,029,927 | 6/1977 | McMillan | 219/10.55 R |
| 4,157,700 | 6/1979 | Conner | 219/10.55 R |
| 4,165,455 | 8/1979 | Mayfield | 219/10.55 A |
| 4,310,738 | 1/1982 | Moretti et al. | 219/10.55 A |
| 4,310,739 | 1/1982 | Hatem | 219/10.55 A |
| 4,313,798 | 2/1982 | Myers, Jr. | 219/10.55 A X |
| 4,386,109 | 5/1983 | Bowen et al. | 219/10.55 R |
| 4,417,116 | 11/1983 | Black | 219/10.55 A |
| 4,593,169 | 6/1986 | Thomas | 219/10.55 R |
| 4,694,133 | 9/1987 | Le Viet | 219/10.55 A |
| 4,967,052 | 10/1990 | Krapf | 219/10.55 R |
| 5,247,148 | 9/1993 | Mencher | 219/10.55 A |

*Primary Examiner*—Philip H. Leung
*Attorney, Agent, or Firm*—Swanson & Bratschun

[57] ABSTRACT

An apparatus and method for heating water using a microwave powered boiler. The apparatus consists of a three cabinet arrangement which permits the dry incorporation of wave guides and the tunneling of microwave energy completely around and into a seamless water chamber. The apparatus can be adapted to provide a hydronic heating system, a forced hot air heating system, a tankless domestic hot water supply and a hot water heater.

14 Claims, 9 Drawing Sheets

MICROWAVE HOT WATER HEATING SYSTEM

FIELD OF THE INVENTION

This invention relates generally to a method and apparatus for heating water using electromagnetic energy, and more particularly to a water heating device in which microwave energy is used to generate hot water, which can then be used directly in circulation or distribution or in a combination of both or indirectly in forced hot air heating systems or otherwise.

PRIOR ART

Conventional water heaters use electricity, gas or oil to heat water, which is then used as a source of heat and/or as a source of hot water. The major disadvantage of conventional energy sources is that they are inefficient. Further, fossil fuels such as gas and oil contribute to air pollution and thus negatively impact the environment and deplete natural resources, and conventional electric systems, which generate heat primarily by resistance, are relatively slow to react. In response to a demand for cleaner, more efficient and thus, more cost effective means to generate heat, a number of systems employing alternative sources of energy have been described in the prior art, including a number of microwave-based hot water heating systems and hot water heaters.

In general, the microwave heating systems and hot water heaters disclosed in the prior art consist of one and two cabinet arrangements in which microwave energy is either directly or indirectly applied to the fluid to be heated. The fluid to be heated is either stored in a tank or is passed through a tube. A significant disadvantage of most of these systems is that the magnetrons or wave guides are arranged such that they are either in direct contact with the fluid flow or they are mounted on a wall that is in direct contact with the fluid flow "wet wall". The water chambers in these systems are typically constructed of metal through which an opening is cut and then covered with a microwave permeable material, typically glass. This arrangement creates seams which causes glass-to-metal seal problems resulting in potential leakage of microwaves, heat and water. Further, the tank devices tend to heat unevenly and, therefore, inefficiently and the tubular coil type devices typically are designed to heat only very small amounts of water. The focus therefore, has been to design microwave heating systems which overcome these shortcomings and it will be helpful to review some of the more pertinent prior art to better explain what is still missing from current attempts to design microwave heating systems.

U.S. Pat. No. 4,165,455 of Mayfield describes a boiler that utilizes microwave radiation to produce steam or hot water by means of a one cabinet arrangement. The invention consists of a boiler chamber, which stores water and reflects microwave energy, a source of microwave energy (preferably a magnetron), and a resonant cavity, which is located near or at the water surface and which acts to localize the energy for heating near or at the water surface. The magnetron and wave guide are mounted on the outside of the water chamber and are separated from the water chamber by a translucent window. The electromagnetic energy produced by the magnetron is coupled from the wave guide into the resonant cavity through the translucent window. The object of this invention is to provide a boiler design that localizes energy for heating near or at the water surface during the production of steam.

U.S. Pat. No. 4,967,052 of Krapf discloses a microwave heat pipe heating system, consisting of a water-filled, microwave permeable pipe which is first passed through a microwave containment enclosure and then into a domestic hot water tank. This is a two cabinet arrangement with water storage on top and heating on the bottom. The magnetron is mounted on the lower cabinet. A sealed pipe at a 45 degree angle is connected between both cabinets. The object of the invention is to provide a microwave heating system that will heat a domestic water supply indirectly. This is accomplished by heating the water in the lower half of the pipe which is within the microwave containment enclosure, thereby creating steam which rises into the upper half of the sealed pipe heating the water in the storage tank by convection. This indirect system does not have the magnetron mounted on a "wall", that is a wall that is in direct contact with the water chamber. The major drawback of this system, however, is that it contains a sealed pipe that has no pressure relief and is not refillable.

U.S. Pat. No. 4,029,927 by McMillan describes a microwave water heater which consists of a two cabinet arrangement—an outer shell and an inner storage tank separated by insulation. A distributor plate is located at the bottom of the water tank. This plate has a number of holes in it and acts to distribute the cold water evenly, as the water is forced in below this plate. The system contains a microwave generator which is mounted on the outside wall of the water tank and is arranged to direct electromagnetic energy directly into the water tank.

U.S. Pat. No. 4,310,739 by Hatem describes a fluid heater powered by microwave energy, which consists of a one cabinet arrangement made up of two halves, top and bottom, separated by a plexiglass sheet. The bottom half contains no water and is broken up into compartments with a microwave energy stirrer that is centrally located. The magnetron is mounted outside of this bottom half. Microwaves generated by the magnetron are directed upward by the fan through the plexiglass sheet and are dispersed through the water, which is located in the top half of the container.

U.S. Pat. No. 3,920,945 by Smith et al. describes a microwave fluid heater consisting of a one cabinet arrangement. Microwave energy generated by a magnetron located at the top of the cabinet is directly applied to the fluid within the cabinet by a wave guide located within the water tank.

U.S. Pat. No. 4,417,116 by Black describes an apparatus in which a conductor body with multiple passages for heating liquids, such as water, is passed through a microwave chamber. The microwave chamber is a two cabinet arrangement consisting of an inner shell formed of a microwave reflective material encased within an outer shell with insulation between the two shells. The main disadvantage of this system is that it is designed to heat only small amounts of water as it flows with no capacity for storage or recovery. A water distribution system is also described in which a plurality of microwave fluid heaters are arranged at different locations. Finally, U.S. Pat. No. 4,593,169 by Thomas, like McMillan, U.S. Pat. No. 4,029,927, also discloses a two cabinet arrangement consisting of an outer shell and an inner storage tank with insulation between the shells.

The water tank is separated by a horizontal partition into upper and lower chambers. Incoming cold water enters the upper chamber and is heated by microwave energy generated by a magnetron. A transfer conduit and a pump conduct the flow of hot water between the upper and lower chambers. The magnetron is mounted to the top of the upper water chamber and is arranged to direct electromagnetic energy directly into the upper water chamber.

From this overview it becomes apparent that most of the systems disclosed in the pertinent prior art have failed to overcome the glass-to-metal seal problems caused by the use of a metal water chamber, which necessitates a window to allow entrance of the microwave energy and which also necessitates the arrangement of the wave guides and/or the magnetron itself on a "wet wall". In fact in five of the seven references cited, namely, Smith, Mayfield, Hatem, McMillan, and Thomas, either the wave guides or the magnetron itself are mounted on a "wall wall". Although the Krapf system has overcome this problem, in doing so the Krapf system has employed a sealed pipe which is indirect, has no pressure relief and is not refillable. The Black system has also overcome this problem, however, this system has the disadvantage of being designed to heat only small amounts of water in flow with no storage capacity or recovery. Accordingly, there exists a need for an improved, energy efficient microwave powered heating system which has capacity for storage and recovery, and in which neither the magnetron nor the wave guides are mounted on a wet wall, thereby alleviating the glass-to-metal seal problems inherent in these systems.

It is an object of this invention to replace current forms of power used to generate hot water heat with cleaner microwave energy and in doing so to provide a water heater which is more efficient than the water heaters currently available. It is a more specific object of this invention to provide a microwave powered heating system in which both the magnetron and the wave guides are on a "dry wall", that is, a wall that is not in direct contact with the water chamber. It is another object of this invention to provide a system that heats the fluid more evenly and thus more efficiently than the systems currently available. Finally, it is another object of this invention to provide a system in which pipe openings are arranged thermodynamically and in which the electrical arrangement is for the proper ampacity and cubic space needed for housing.

SUMMARY OF THE INVENTION

The present invention includes a microwave powered boiler which can be adapted to provide a hydronic heating system, a forced hot air heating system or a tankless domestic hot water supply. This invention also includes a microwave powered hot water heater.

In brief, the boiler of this invention is comprised of a unique three cabinet arrangement. The first cabinet is an outer jacket which supports a control panel and provides mechanical protection as well as personal intervention and accessibility. The second cabinet is a dry cabinet/energy exchanger for the containment and reflection of the microwave energy and to which the wave guides are welded and fused and are thus an integral part. Finally, there is a wet cabinet or water chamber for the storage and the circulation of the water as well as for the absorption of the energy. This three cabinet arrangement creates two interior wall spaces. The outside wall space contains insulation of a high R value and the inside wall space is a thermal wall. The thermal wall receives the dry heat energy by-product removed from the magnetron.

When the ambient temperature of the area to be heated drops below the setting of the thermostat, electrical current is supplied to the power supply which generates electromagnetic energy. This energy is directed into the energy exchanger by wave guides which are an integral part of the dry cabinet wall making up the energy exchanger. The electromagnetic energy then passes through the microwave permeable walls of the water chamber, thereby heating the water in the chamber.

The pipe openings of the boiler are arranged thermodynamically and the electrical circuitry is arranged for the proper ampacity. Electrical interruption to the power supply is achieved intermittently by a high limit control that cycles automatically with the water temperature in circulation. Pressure relief is achieved by the "spring-plunger" technique. When high pressure is applied to the plunger the valve will open giving relief. When relief has been achieved the spring will return the plunger closing the valve. A suitable operating temperature of the system is 140–180 degrees fahrenheit with pressure relief at 30 psi. The boiler can be adapted to provide a hydronic heating system with an optional tankless domestic water supply or a forced hot air heating system with an optional tankless domestic water supply.

Additionally, this invention offers a hot water heater, which is also comprised of the unique three cabinet arrangement. The first cabinet is an outer jacket which supports the control panel and provides mechanical protection as well as personal intervention and accessibility. The second cabinet is a dry cabinet/energy exchanger for the containment and the reflection of the microwave energy and to which the wave guides are welded and fused. Finally, there is a wet cabinet/water chamber constructed of non-metallic microwave permeable material for the storage and the distribution of the water as well as the absorption of the microwave energy.

In a preferred embodiment this system can also be designed to create a temperature gradient within the water tank. This is achieved by using upper and lower thermostats that are set 30 degrees apart. This creates a thermal arrangement with the upper water being 30 degrees hotter and therefore, lighter than the bottom water. As hot water is removed from the top zone, it is replaced by preheated water from the bottom zone, which is then replaced by preheated water from a supply pipe. The supply pipe is then refilled with cold water supplied through a cold water inlet. In this way recovery time is kept to a minimum.

Accordingly, this invention consists of a unique three cabinet arrangement which permits the dry incorporation of wave guides and the tunneling of electromagnetic energy completely around and into the water chamber, while creating a thermal wall using the dry heat by-product generated by the magnetron. This invention can be more fully understood when the detailed description which follows is read with reference to the accompanying drawings.

BRIEF DESCRIPTION OF THE DRAWINGS

FIG. 2A is a view of the front right side of the boiler and FIG. 2B is a view of the rear left side.

FIG. 7A is a view of the forced hot air heater from the front right side and FIG. 7B is a view from the rear left side.

DETAILED DESCRIPTION OF THE INVENTION

The microwave powered boiler and hot water heater of this invention are designed such that microwave energy is indirectly applied to the fluid to be heated through a dry cabinet/energy exchanger which completely surrounds the fluid chamber. This design allows for a dry wave guide arrangement, thus overcoming the glass-to-metal seal problems inherent in systems currently available in which the magnetron or wave guides are mounted on a "wet wall". This design also results in more uniform distribution of the microwaves into the water chamber, and, as such, more efficient heating. The invention will be described first with a discussion of the microwave powered heating system, followed by a detailed discussion of the boiler including adaptations to provide a tankless hot water heater and a forced hot air heating system. Finally, the hot water heater of this invention will be discussed.

Figure 1:
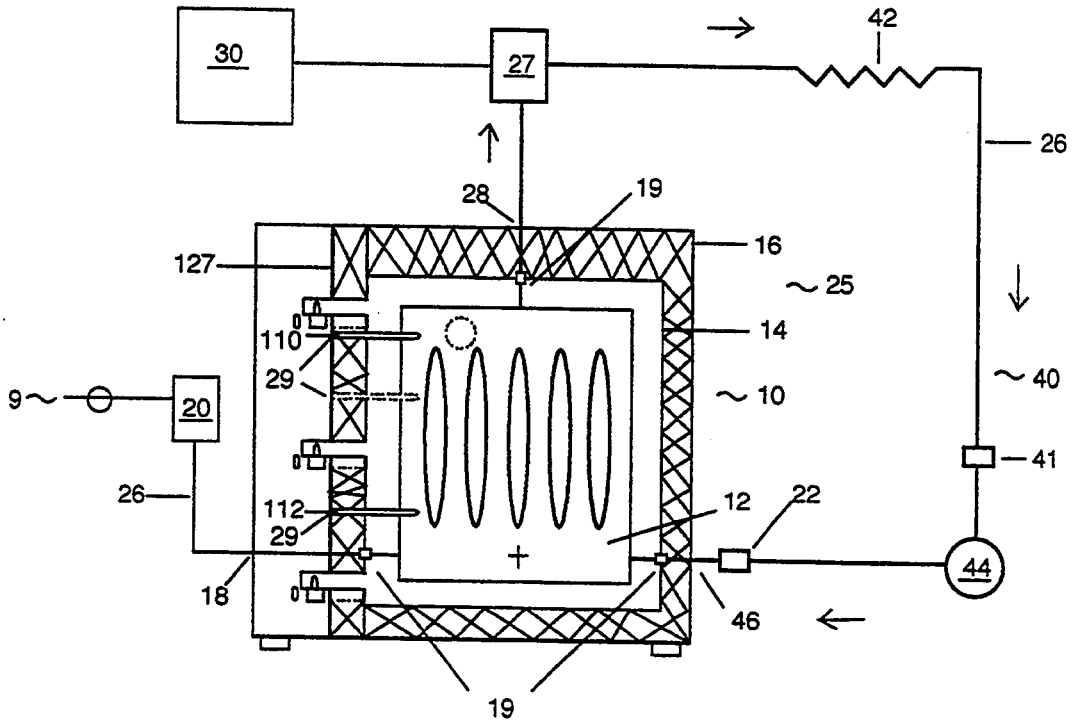
FIG. 1 is a perspective view of the hydronic heating system of this invention.

As illustrated in FIG. 1 the hydronic heating system 25 of this invention includes a boiler 10, water inlet system 9, water circulator system 40, associated control circuits and power supply (shown elsewhere). The boiler 10, includes a three cabinet arrangement. First, an outer cabinet/jacket 16 which supports the control panel at the grounded frame 127. Second, a dry cabinet/energy exchanger 14 and finally, a wet cabinet the water chamber 12, with nipples 19 and immersion wells 29 discussed later in more detail.

A standard water supply is connected to the water inlet system 9, which includes conduit 26, standard plumbing connections (not shown) and a boiler feed/-pressure relief valve 20. This valve maintains the water/pressure in the system. Conduit 26 extends from the boiler feed/pressure relief valve 20 to opening 18 on the outer cabinet 16 and into the water chamber 12. At the top of the boiler 10 is a heat rise check valve 27, which keeps the hot water from gravitating, prevents backflow and provides a tap for the expansion tank 30.

The water circulation system 40 includes conduit 26, standard connections (not shown), baseboard heaters 42, a purge valve 41, which can be used to purge the system of any buildup of air, and a circulating pump 44. The water circulation system 40 is in fluid communication with the boiler 10 through outlet 28 and return inlet 46 located at the bottom of the boiler 10. A check valve 22 which eliminates backflow is placed between the circulator 44 and the water chamber 12.

Figure 2A:
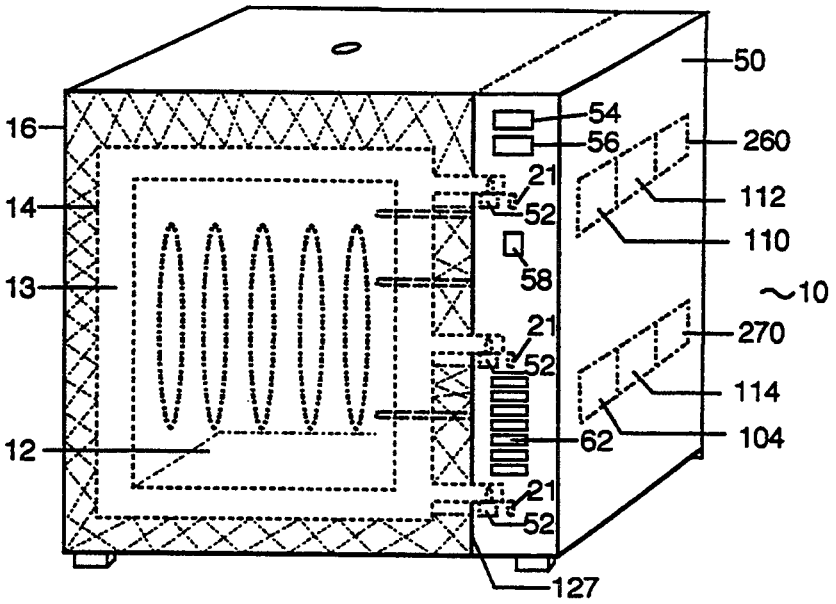
FIGS. 2A and 2B are more detailed perspective views showing details of the boiler portion of this invention.
Figure 2B:
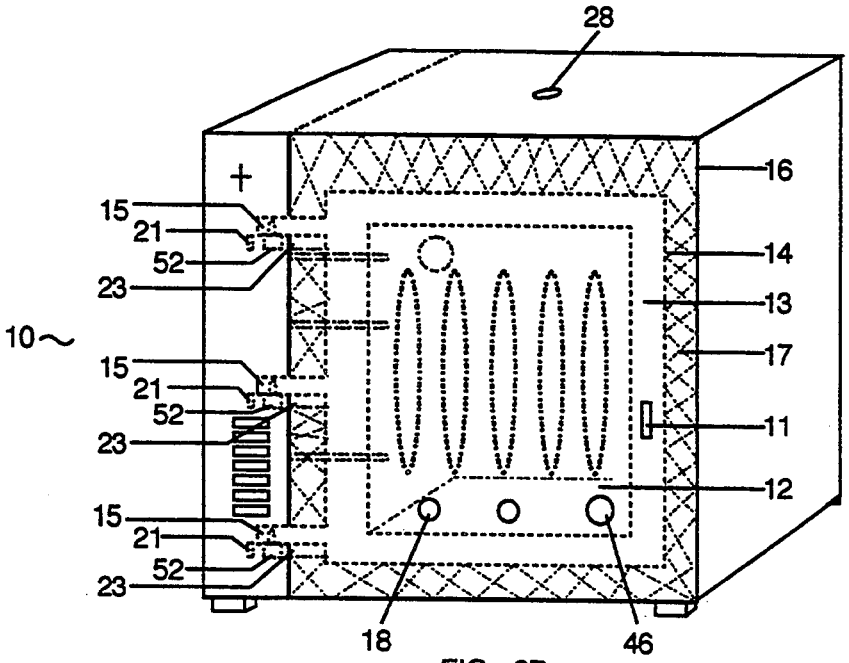

The boiler 10, is shown in more detail in FIGS. 2A and 2B. It preferably has a rectangular shape, although it may have a cylindrical or any other desired shape. Referring to FIG. 2A, which displays the front right side of the boiler 10, it can be seen that the boiler 10 consists of a three cabinet arrangement. The first cabinet 16 is an outer jacket which at grounded frame 127 supports the control panel 50 and encases the energy exchanger 14 and the water chamber 12. This outer jacket 16 is constructed of a metallic material, such as galvanized sheet metal or anodized aluminum or of non metallic structural plastic, such as high density polyethylene. Feed water is provided using standard conduit and pipe connections (not shown) through inlet 18 depicted in FIG. 2B, which is a view of the rear left side of the boiler 10. The position of the water outlet 28 and return inlet 46 for the water circulation system is also shown in FIG. 2B.

Rigid polyurethane foam 17 of high R value preferably at least 2 inches thick is placed between the interior surface of outer cabinet 16 and the exterior surface of the energy exchanger 14. This insulation 17 eliminates heat loss from the thermal wall 13 and water chamber 12, gives strength to the unit and resilience to the outer wall as well as acoustics.

Spaced inwardly from the outer cabinet 16 there is a dry cabinet, the energy exchanger 14, which has the same shape as the outer cabinet 16, but is somewhat smaller in size. The walls of the energy exchanger 14 are constructed of stainless steel or other microwave impermeable material. The energy exchanger 14, which completely surrounds the water chamber 12, is a dry cabinet for the containment and reflection of microwave energy. Wave guides 15 are welded and fused to the inside wall of this dry cabinet and direct microwave energy into the energy exchanger 14. The wave guides 15 are constructed of stainless steel which is structurally and physically part of the cabinet. The transmitter of the magnetron 52 is inserted into the wave guide 15 where the energy is released and tunneled into the energy exchanger 14. Axial fans 21 are located behind the magnetron 52 and serve to cool the magnetron 52 and direct the heat generated by the magnetron 52 into the thermal wall 13 space through a heat register 23 located below the wave guide 15 openings and in front of the magnetron 52. Air pressure relief of the thermal wall 13 is provided by valve 11. This arrangement, in which the energy exchanger 14 completely surrounds the water chamber 12, allows the microwaves to be evenly distributed around and into the water chamber 12. This even distribution facilitates a more even or consistent, and, as such, a more efficient heating of the water in the water chamber 12.

Spaced inwardly from the energy exchanger 14 is the wet cabinet, the water chamber 12 which is seamless and has the same shape as the energy exchanger 14, but again is somewhat smaller in size and is surrounded by the thermal wall 13 space. The water chamber 12 is constructed of a microwave permeable material such as a thermal plastic or ceramic. Nipples 19 (see FIG. 1) extend from the outer cabinet 16 into the water chamber 12. At the outer cabinet 16 openings, the end of the nipples (19) have dielectric national pipe thread (NPT)

tapped openings. Extending from these openings is a stainless steel nipple 19 which ends at a change over fitting (male/female, foot valve type arrangement) which is welded and fused to the energy exchanger 14 wall, and then changes to a microwave permeable material extending into the water chamber 12. The nipples 19 hold the cabinets together and maintain wall space.

This unique three cabinet arrangement creates two wall spaces. The outside wall space exists between the inside wall of the outer cabinet 16 and the outside wall of the energy exchanger 14 and contains insulation 17 of a high R value. The inside wall space 13 exists between the inside wall of the energy exchanger 14 and the outside wall of the water chamber 12. This space 13 is approximately 2 inches wide and receives both the heat by-product and the microwave energy generated by the magnetron 52. In addition to the thermal insulation value, this space 13 also allows the water chamber 12 to breathe and keeps the energy exchanger 14 a dry cabinet.

Referring back to FIG. 2A, the control panel 50 contains a conventional magnetron 52, a temperature gauge 54, a pressure-altimeter gauge 56, service switch 58, controls 110, 112, and 260, relays 104, 114, and 270 and air vents 62. Air vents 62 vent the control panel 50 in conjunction with the axial fans 21 which create a vacuum drawing air through the vents 62 which first cools the electrical equipment in the control panel 50 and then flows across the magnetron and into the thermal wall 13. This arrangement provides mechanical support as well as central accessibility for purposes of service and repair.

Figure 3:
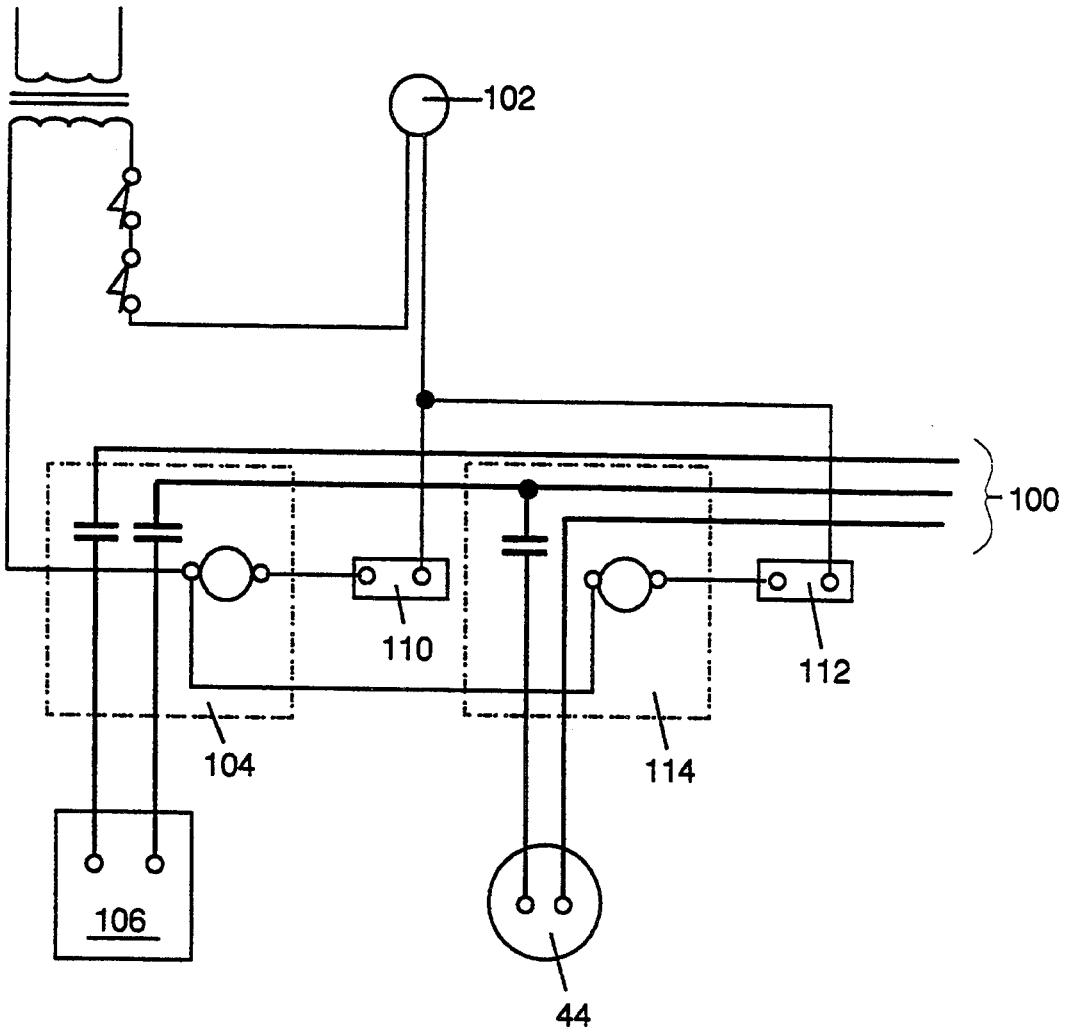
FIG. 3 is a circuit diagram of the electrical control system of this invention.

The electrical control circuitry is depicted in FIG. 3. In overview it can be seen that the electrical control circuitry of this invention includes a thermostat 102, a power supply 106, and a circulator 44 and various relays 104 and 114. The circulator 44 has a reverse acting control 112 which interrupts the circulator 44 intermittently.

When the ambient temperature drops below the setting on the thermostat 102, the thermostat 102 causes contacts in the power supply relay 104 to close, sending electric current from a 110/220 v single phase standard electrical supply 100 (could be altered for three phase) to the power supply 106 (discussed in more detail below). The power supply 106 heats the water in the chamber by means of electromagnetic waves generated by a conventional magnetron 52. These waves are directed into the energy exchanger 14 by the wave guides 15 which are welded and fused to the wall of the energy exchanger 14. The electromagnetic energy then passes through the microwave permeable walls of the water chamber 12, thereby heating the water in the chamber. The power supply 106 will continue to run until the temperature in the area to be heated reaches the setting of the thermostat 102, or until the temperature of the water in the water chamber 12 reaches the setting on the high limit control 110.

A reverse acting control 112 is used to delay the start and interrupt the circulator 44 intermittently during the heating cycle in order that the temperature of the water can rise and be maintained. A time delay relay could also be used to delay the start of the circulator 44. When the temperature of the water in the chamber reaches the setting on the reverse acting control 112, this causes contacts in the circulator relay 114 to close, sending electric current to the circulator 44, which then begins to pump the hot water throughout the system. The circulator 44 will continue to run until the desired ambient temperature is reached or until the temperature of the water in the chamber drops below the setting on the reverse acting control 112. If the desired ambient temperature is reached before the high limit control 110 setting, then the power supply 106 and circulator 44 will go off together.

The sensing elements of the various controls are located in immersion wells 29 (see FIG. 1). The wells 29 are in a horizontal position extending from the control panel 50 to the energy exchanger 14, where they are welded and fused and then into the water chamber 12. In addition to housing the sensing elements, the wells 29 help to hold the cabinets together and maintain wall space.

The preferred working temperature of the system is 130–180 degrees fahrenheit with fixed pressure relief at 30 psi. Electrical interruption to the power supply 106 is achieved by a high limit control 110 that is heat sensitive and cycles with the temperature of the water in the chamber. Pressure relief is achieved by the "spring-plunger" technique. When high pressure is applied to the plunger the valve will open giving relief. When relief has been achieved the spring will return the plunger closing the valve.

Figure 4:
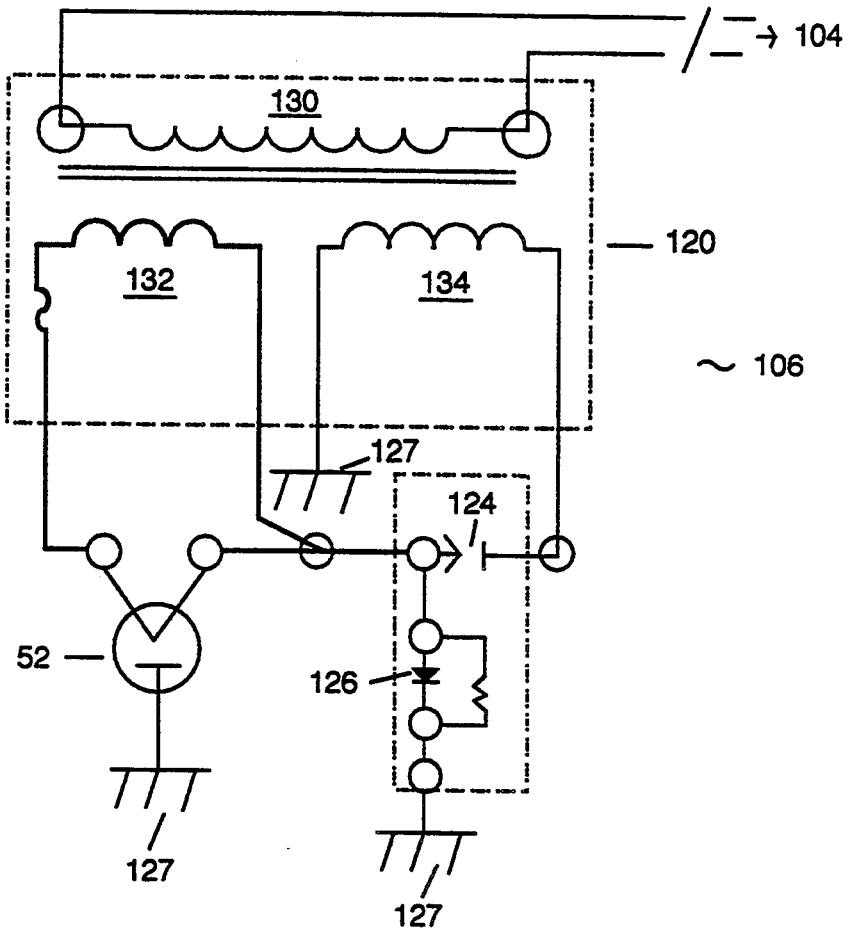
FIG. 4 is a circuit diagram of the power supply of this invention.

Referring to FIG. 4, the power supply 106 is comprised of a high voltage transformer 120 (which has a single primary winding 130 and a split secondary winding 132 and 134), conventional magnetrons 52 (wired in parallel), a high voltage capacitor 124, and a high voltage diode 126. One of the split secondary windings of the power transformer 120 produces high voltage 134 and the other low voltage 132. The low voltage 132 is supplied to the filament (heater) of the magnetron 52. The high voltage 134 is supplied to the magnetron 52 in two legs. One leg is supplied to the high voltage capacitor 124. When the high voltage capacitor 124 is charged the high voltage diode 126 rectifies the high voltage 134 alternating current to high voltage direct current which is now common to one leg of the filament which creates a heated cathode. The other leg of the high voltage 134 is attached to the grounded frame 127 which is in continuity with the magnetron 52, wave guide 15, and the energy exchanger 14 (shown in FIGS. 2A and 2B). The electromagnetic waves generated by the magnetron 52 are directed through the wave guides 15 into the energy exchanger 14 where they are reflected and absorbed by the water in the chamber. The microwave source can be designed to heat a single chamber of water or a series of smaller chambers.

Figure 5:
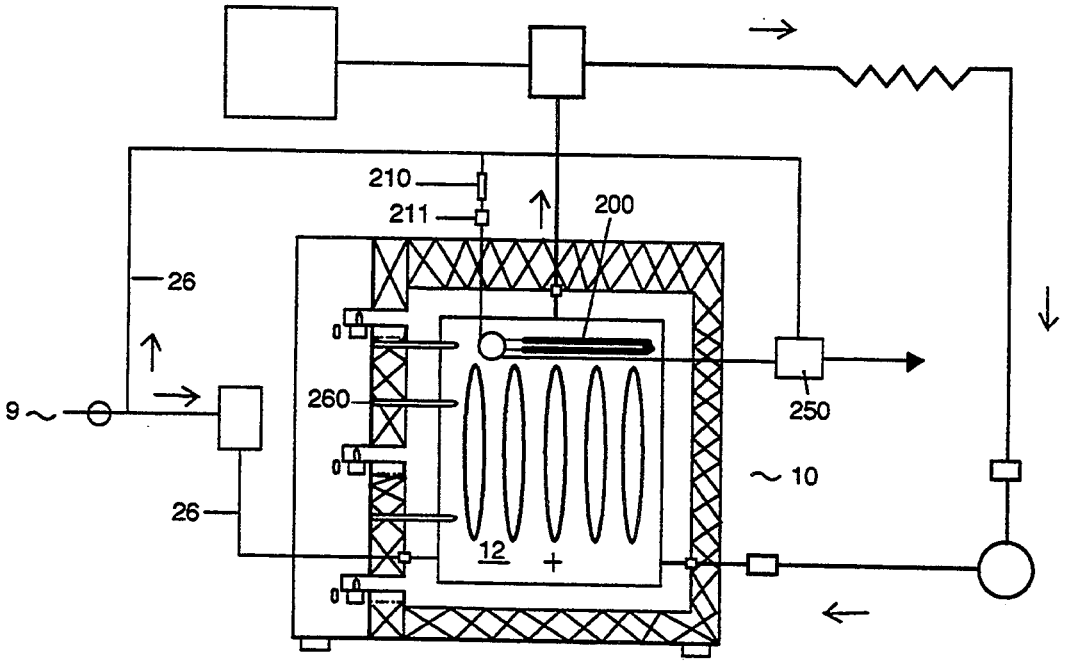
FIG. 5 is a perspective view of the invention depicted in FIG. 1, in which the hydronic heating system has been adapted to include a tankless hot water heater.

In another embodiment of the present invention, shown in FIG. 5, a hot water supply can be achieved by placing a tankless microwave permeable coil 200 into the water chamber 12. One end of the coil 200 is connected to a cold water supply through water inlet means 9, using standard conduit 26 and standard connections (not shown). A restrictor valve 210 controls the rate at which cold water is fed into the coil 200. This is typically set at 3.5 gallons per minute. A pressure relief valve 211 is inserted near the inlet of the coil 200 (pressure relief 150 psi fixed). The hot water outlet of the coil 200 is mixed with cold water at a tempering valve 250 to the desired temperature. Cold water is supplied to the tempering valve 250 using standard conduit 26 via water inlet means 9.

Figure 6:
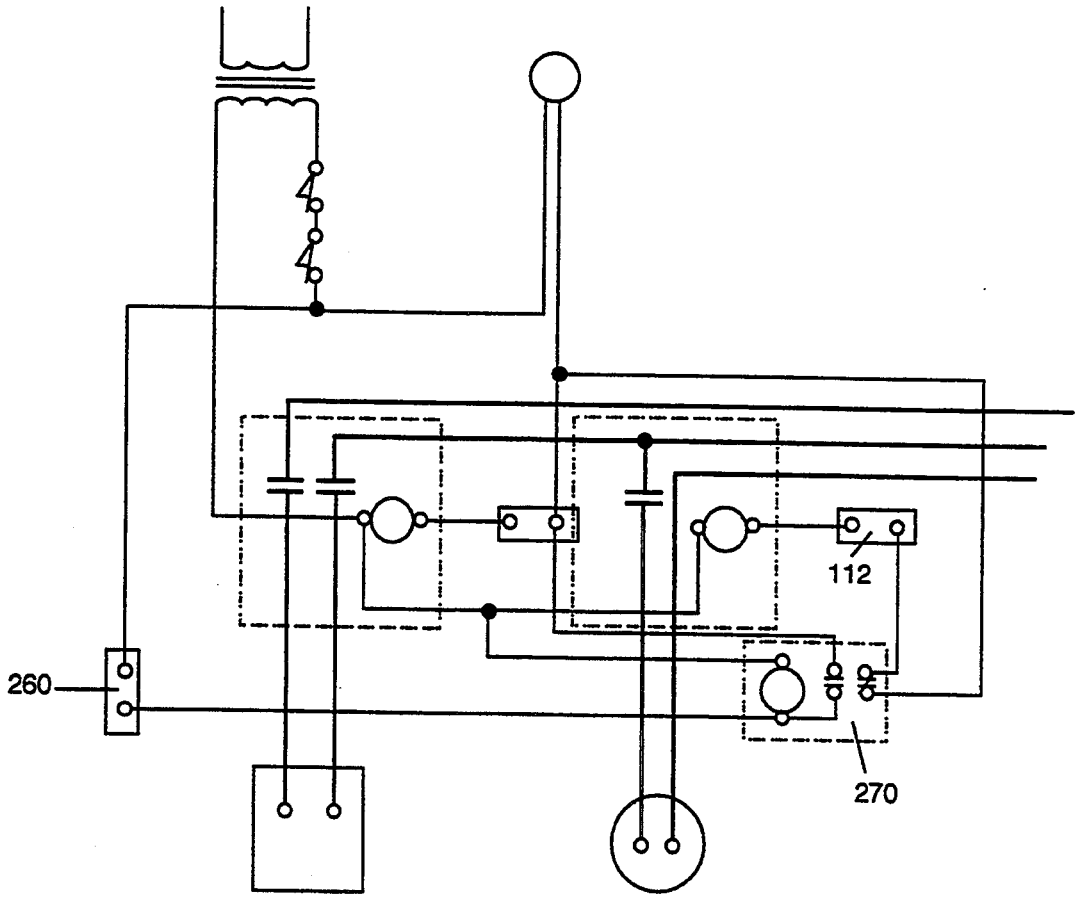
FIG. 6 is a circuit diagram of the electrical control system of the version of this invention shown in FIG. 5 in which the boiler is adapted to include a tankless hot water heater.

The electrical control circuitry for this alternate version of the invention is depicted in FIG. 6. It can be seen that included in the electrical control circuitry of this version is an operating control 260 and an off cycle relay 270. The operating control 260 is used to maintain the chamber water temperature. When the temperature of the water in the chamber falls below the setting of the operating control 260, the power supply 106 is turned on and remains on until the operating setting has been reached. During seasons when the heating cycle is in operation, the chamber water temperature is maintained by action of the operating control 260 and the reverse acting control 112 as described above. During non-heating cycles the operating control 260 alone maintains the temperature of the water in the chamber. The off cycle relay 270 interrupts the circulator intermittently while the power supply 106 is on, this action allows the water temperature to rise in the water chamber and also to turn on the power supply 106 in non heating cycles or seasons.

Figure 7A:
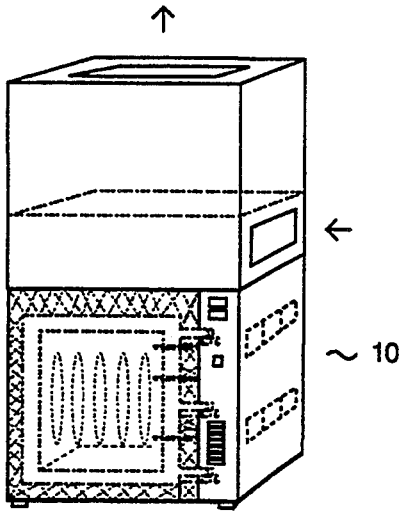
FIGS. 7A and 7B are perspective views of an alternative embodiment of this invention in which the boiler has been adapted to provide forced hot air heat.
Figure 7B:
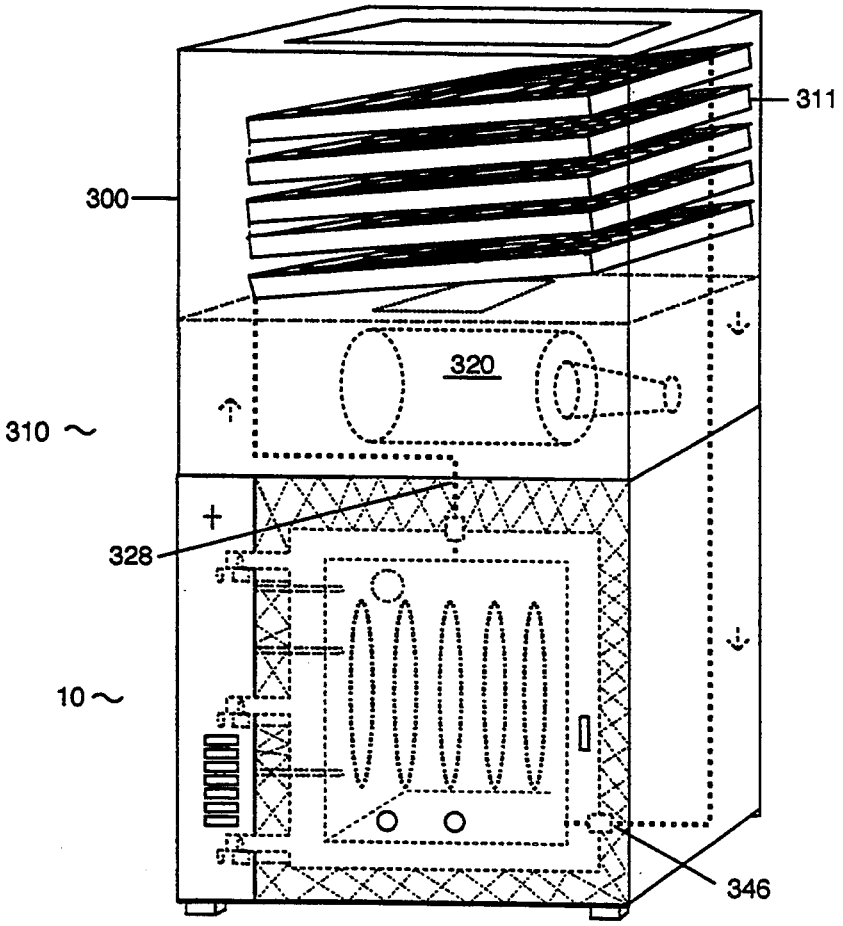

Referring to FIGS. 7A and 7B, it may be seen that in yet another embodiment the boiler 10 of this invention can be adapted to a conventional forced hot air heating system 310. In this version of the invention a plenum chamber 300, constructed of galvanized sheet metal or anodized aluminum is placed on top of the boiler 10. The plenum chamber 300 houses a series of convectors 311 and a blower 320. When the thermostat calls for action the boiler 10 comes on and the heated water gravitates from outlet 328, located at the top of the water chamber into a series of convectors 311 and returns to the water chamber through inlet 346 located at the bottom of the water chamber. A fan control is used to control the blower 320. When the temperature in the plenum chamber 300 reaches the upper setting on the fan control the blower 320 is activated and remains on until the thermostat is satisfied or the temperature in the plenum chamber 300 drops below the setting of the fan control interrupting the blower 320 intermittently thus allowing the plenum chamber 300 to come up to temperature.

Figure 8:
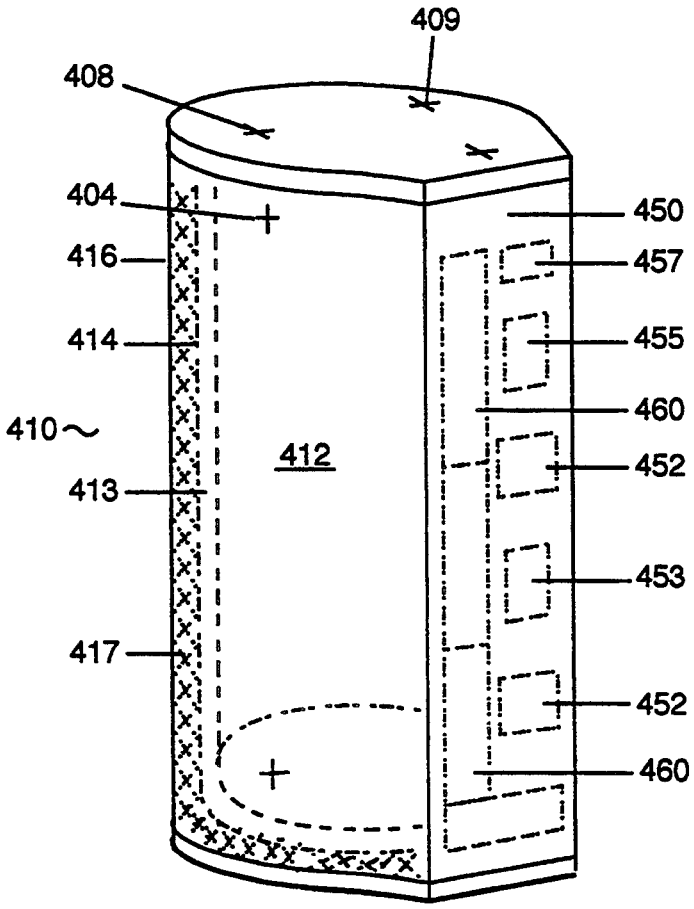
FIG. 8 is a perspective view of the hot water heater of this invention.

Referring to FIG. 8, this invention also provides a hot water heater 410 with storage. The hot water heater 410 preferably has a cylindrical shape, although it may have any other desired shape. Like the boiler 10, the hot water heater 410 consists of a three cabinet arrangement, which is very similar to the boiler 10. The outer cabinet is a jacket 416 that supports the control panel 450 at the grounded frame 127 (shown in FIG. 9 and discussed in reference to FIG. 4) and encases the energy exchanger 414 and the water chamber 412. The outer jacket 416 is constructed of a metallic material such as galvanized sheet metal or anodized aluminum or of a non metallic structural plastic, such as high density polyethylene. Feed water is provided using standard conduit and connections (not shown) through inlet 409 and the hot water is supplied through outlet 408.

Spaced inwardly from the outer cabinet 416 is the energy exchanger 414 which has the same shape as the outer jacket 416, but is somewhat smaller in size. The walls of the energy exchanger 414 are constructed of a microwave impermeable material such as stainless steel. The energy exchanger 414 completely surrounds the water storage tank 412 and is a dry cabinet for the containment and reflection of microwave energy. Wave guides 415 (shown in FIG. 9) are welded and fused to the inside wall of this dry cabinet and are arranged to direct microwave energy into the energy exchanger 414. The wave guides 415 are constructed of stainless steel which are structurally and physically part of the energy exchanger 414. Axial fans 421 (shown in FIG. 9) are located behind the magnetron 452 and serve to remove the dry heat by-product of the magnetron 452 and direct the heat energy, through heat register 423 (shown in FIG. 9) into the thermal wall 413 space, which has pressure relief. This arrangement, in which the energy exchanger 414 completely surrounds the storage tank 412, allows the microwaves to be evenly distributed around and into the storage tank 412. This even distribution facilitates a more efficient heating of the water in the water chamber 412.

Standard insulation 417 of a high R value preferably at least two inches thick is placed between the interior surface of outer cabinet 416 and the exterior surface of the energy exchanger 414. This insulation 417 eliminates heat loss from the thermal wall 413 and storage tank 412, gives strength to the unit and resilience to the wall of the outer cabinet 416.

Spaced inwardly from the energy exchanger 414 is the water storage tank 412, which is seamless and has the same shape as the energy exchanger 414, but is somewhat smaller in size. This wet cabinet 412 is constructed of a microwave permeable material such as thermal plastic or ceramic. Nipples 419 (shown in FIG. 9) extend from the outer cabinet 416 into the water chamber 412, as discussed earlier.

This unique three cabinet arrangement creates two wall spaces. The outside wall space exists between the inside wall of the outer cabinet 416 and the outside wall of the energy exchanger 414 and contains insulation 417 of a high R value. The inside wall space 413 exists between the inside wall of the energy exchanger 414 and the outside wall of the water storage tank 412. This space is approximately 2 inches wide and receives both the heat by-product and the microwave energy generated by the magnetron 452. In addition to the thermal insulation value, this space 413 also allows the water chamber 412 to breathe and keeps the energy exchanger 414 a dry cabinet.

The control panel 450, contains a conventional magnetron 452, an upper thermostat 455, a lower thermostat 453, a high limit control 457, and relays 460. This arrangement provides mechanical support as well as central accessibility for purposes of service and repair.

Electrically, the hot water heater 410 is designed similarly to the boiler 10. In a single temperature zone system, when the temperature of the water in the storage tank 412 is below the temperature setting of the thermostat 455, the power supply 106 is turned on by the action of the relays 460 and cycles on and off intermittently to maintain water temperature. Electrical interruption from a 220 v single phase electrical branch circuit is achieved by a high limit cut off 457 that is heat sensitive and resetable. Pressure and temperature relief are achieved by a fixed temperature pressure relief valve 404 located at the top side of the water heater 410. The system is operated at the same pressure as the pressure of the water supply.

Figure 9:
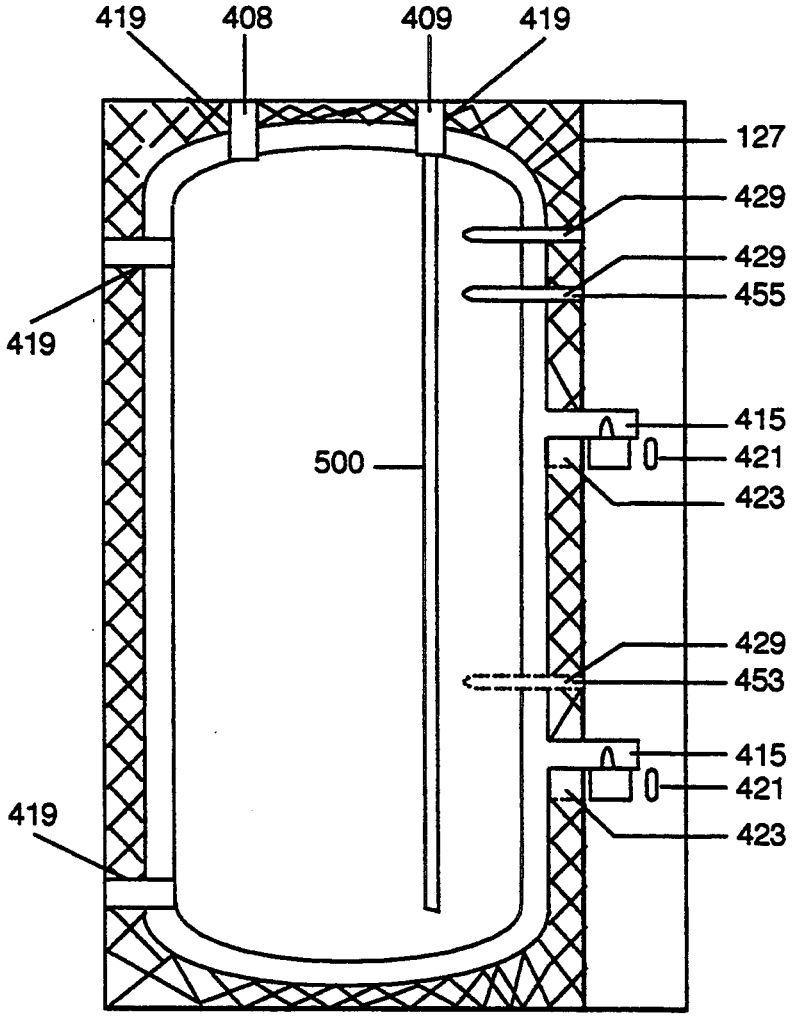
FIG. 9 is a more detailed view of the water storage tank of the hot water heater depicted in FIG. 8.

With reference to FIG. 9 the system can also be designed to provide a temperature gradient. This is achieved by using upper 455 and lower 453 independent or interlocked thermostats that are set 30 degrees apart. The temperature sensing elements of the various temperature controls are located in the immersion wells 429 as discussed earlier. This creates a thermal arrangement with the upper water being 30 degrees hotter and therefore, lighter than the bottom water. As hot water is supplied from the top zone through water outlet 408 it is replaced by preheated water from the bottom zone, which is then replaced by preheated water in the supply pipe 500. The supply pipe 500 is refilled with cold water supplied through the cold water inlet 409. In this way recovery time is kept to a minimum.

In summary it can be seen that the system of this invention overcomes the glass-to-metal seal problems caused by the mounting of the magnetron or wave guides on a "wet wall". The unique three cabinet design of the boiler and hot water heater permits the incorporation of the wave guides in the dry wall of the energy exchanger. The three cabinet design with the energy exchanger completely surrounding the wet cabinet also provides a system that heats much more evenly and thus, more efficiently than the systems currently available. In addition, the design also utilizes the dry heat energy generated by the magnetrons to provide thermal insulation to the water in storage. Finally, the present system works in harmony with gravity and the laws of thermodynamics to provide natural and mechanical flow of the water.

While this invention has been described with reference to specific embodiments, the description is not meant to be construed in a limiting sense. Various modifications of the disclosed embodiment, as well as other embodiments of the invention, will be apparent to persons skilled in the art upon reference to this description. It is therefore contemplated that the appended claims will cover any such modifications or embodiments which fall within the true scope of the invention.

What is claimed is:

1. A boiler comprising:

(a) a first cabinet enclosing a fluid, said first cabinet having a microwave permeable seamless peripheral wall;

(b) a second cabinet enclosing the first cabinet, said second having a microwave impermeable peripheral wall having an interior surface facing said first cabinet, thereby forming a thermal conducting space between the first and second cabinets;

(c) a third cabinet enclosing the second cabinet;

(d) a wave guide carried on the interior surface of the microwave impermeable peripheral wall of the second cabinet;

wherein the wave guide is not in contact with the fluid chamber;

(e) a microwave power source operatively connected to the wave guide carried on the interior surface of the second cabinet;

wherein said second cabinet is in continuity with the microwave power source such that the second cabinet is an extension of the wave guide both electrically and mechanically; and (f) heat transport means positioned between the first and third cabinets for transport of a thermal by-product of the microwave power source.

2. The boiler of claim 1, wherein:

(a) said wave guide is oriented so as to direct a microwave generated by the microwave power source towards the microwave permeable wall of the first cabinet; and (b) said microwave impermeable peripheral wall of the second cabinet is adapted to reflect a microwave misdirected into the first cabinet back into the thermal conducting space.

3. The boiler of claim 2, further comprising a plurality of wave guides.

4. The boiler of claim 2, wherein the thermal conducting space is not in fluid communication with the fluid chamber of the first cabinet.

5. The boiler of claim 4, further comprising:

(a) an insulating space between the second cabinet and the third cabinet; and (b) an insulating medium carried within said insulating space.

6. The boiler of claim 5 further comprising control means for controlling the microwave power source wherein the control means is accessible from a wall common to the third cabinet.

7. The boiler of claim 6 further comprising a non-metallic jacket for the third cabinet.

8. The boiler of claim 1, further comprising a primary inlet for carrying a primary fluid into the fluid chamber and primary outlet for carrying said fluid out of the fluid chamber, and a conduit connecting the inlet with the outlet for circulating said fluid back into the fluid chamber, wherein said microwave generated by the microwave power source in conjunction with the thermal heat is adapted to heat said fluid with said fluid chamber.

9. The boiler of claim 8, further comprising a secondary inlet for carrying a secondary fluid into the fluid chamber, a secondary outlet for carrying said fluid out of the fluid chamber, and a microwave permeable coil disposed between the secondary inlet and the secondary outlet; said coil being disposed within said fluid chamber for carrying said secondary fluid in heat exchange relation but not in fluid communication with said primary fluid in said fluid chamber for heating the secondary fluid by heat exchange with said primary fluid.

10. The boiler of claims 8 or 9, further comprising a tertiary inlet for carrying a tertiary fluid into a plenum chamber operatively connected to said boiler and a tertiary outlet for carrying said tertiary fluid out, and a set of convectors located within said plenum chamber, wherein said conduit joining said primary outlet is in fluid communication with said convectors for introducing said primary fluid into said convectors, wherein said convectors are in heat exchange relationship but not fluid communication with said tertiary fluid for heating said tertiary fluid by heat exchange with said primary fluid within the plenum chamber.

11. The boiler of claim 10 wherein at least one of said primary, secondary and tertiary fluids is air.

12. The boiler of claim 1, wherein the thermal conducting space between the first and second cabinets uniformly surrounds the first cabinet.

13. A method of heating a fluid, comprising:

(a) carrying a fluid into a microwave permeable supply pipe that empties into and out of a microwave permeable seamless chamber within a first cabinet;

(b) enclosing said first cabinet with a microwave impermeable second cabinet, thereby forming a thermal conducting space between the first and second cabinet;

(c) incorporating a wave guide within an interior wall of said second cabinet such that the wave guide is within the thermal conducting space and the wave guide is not in contact with the first cabinet;

(d) connecting the wave guide to a microwave power source which is in continuity with the second cabinet such that the second cabinet is an extension of the wave guide both electrically and mechanically;

(e) orienting the wave guide so as to direct a microwave towards the microwave permeable chamber while preventing the wave guide from contacting said chamber;

(f) directing a microwave and urging a heat by-product of the microwave power source towards the microwave permeable chamber.

14. The method of claim 13, further comprising:

(a) enclosing said second cabinet within a third cabinet so as to create a gap between the second and third cabinets; and (b) maintaining an insulating medium within said gap.

* * * * *